US006135567A

United States Patent [19]

Cochran

[11] Patent Number: 6,135,567

[45] Date of Patent: Oct. 24, 2000

[54] ROTATABLE IMPLEMENT DEPTH CONTROL APPARATUS

[76] Inventor: Gary Cochran, 3052 N. Forrest Lakes, Wichita, Kans. 67205

[21] Appl. No.: 09/183,813

[22] Filed: Oct. 30, 1998

[51] Int. Cl.[7] ..... E01C 23/088

[52] U.S. Cl. ..... 299/39.6; 299/36.1; 299/39.1; 299/39.4; 299/39.6; 172/540; 125/13.01

[58] Field of Search ..... 299/36.1, 39.1, 299/39.3, 39.4, 39.6; 37/302; 172/13, 15, 42, 540, 554; 30/390, 391; 125/13.01, 13.03

[56] References Cited

U.S. PATENT DOCUMENTS 5,382,084 1/1995 Diver et al. ..... 299/39
5,775,781 7/1998 Sawtelle et al. ..... 299/39.8

OTHER PUBLICATIONS

Pavement Repair with the Bobcat Planer, A User's Guide, Melrose Company May, 1997.

*Primary Examiner*—Eileen D. Lillis
*Assistant Examiner*—John Kreck
*Attorney, Agent, or Firm*—Kenneth Jack; Davis & Jack, L.L.P.

[57] ABSTRACT

An apparatus for engaging a surface, the apparatus consisting of a rotatable member for engaging the surface, the rotatable member having an axis of rotation; a rocker, the rocker having a forward end, a rearward end, and a surface contact face, the surface contact face of the rocker extending from the forward end of the rocker to the rearward end of the rocker; and a support wall and drive axle rotatably mounting the rotatable member over the rocker so that, upon contact of the surface contact face of the rocker with the surface, and upon forward or rearward rocking motion of the rocker, the axis of rotation of the rotatable member moves away from or toward the surface, causing the rotatable member to engage the surface at varying depths.

17 Claims, 4 Drawing Sheets

ROTATABLE IMPLEMENT DEPTH CONTROL APPARATUS

FIELD OF THE INVENTION

This invention relates to rotatable chipping, cutting, grinding, milling, planing, and tilling implements. More particularly, this invention relates to such implements, including structure, for controlling the depth at which such implements engage surfaces.

BACKGROUND OF THE INVENTION

Mobile heavy construction equipment such as tractor backhoes, front loader tractors, excavators, and skid steer loaders commonly are equipped with an hydraulic power system which is capable of supplying power to various hydraulically driven implements. Commonly, the dirt scooping or moving bucket of a tractor backhoe or excavator may be removed from such tractor backhoe's or excavator's boom arm. Similarly, the lift bucket of a skid steer loader or of a front loader tractor is commonly removable. In place of such buckets, various auxiliary hydraulically powered implements may be mounted.

Among such auxiliary hydraulically powered implements are implements rotatably driving a wood chipping wheel, blade, or drum; implements rotatably driving concrete cutting wheels, blades or drums; implements rotatably driving grinding wheels, blades, or drums; implements rotatably driving milling wheels, blades, or drums; implements rotatably driving planing wheels, blades, or drums; or implements rotatably driving tined earth tillers. Such implements, when mounted upon the boom arm, or lift arms, as the case may be, of a tractor backhoe, excavator, front loader tractor, or skid steer loader, operatively engage a surface such as a tree stump, a paved road, or bare or sodded ground. In any such application, means are necessary for controlling the depth at which such implements engage such surfaces.

A known depth control means utilizes an hydraulic ram or hydraulic rams for selectively raising and lowering the rotatable member with respect to the surface to be engaged. Typically, such hydraulic rams bias between the rotatable member and a frame which rollably or slidably moves along the surface, or which bias between a mounting plate attached to the boom arm or lift arms, as the case may be, and a cantilevered support arm which suspends the rotatable member. A problem associated with utilizing such hydraulic rams for such depth control is that such hydraulic rams are expensive to install and maintain, such hydraulic rams are subject to excessive wear and breakage, and such hydraulic rams necessitate an additional hydraulic control which is cumbersome for a heavy equipment operator to manipulate.

The instant invention solves the problems outlined above by eliminating hydraulic ram depth control, replacing such rams with a depth controlling rocker.

PRIOR ART PATENTS

U.S. Pat. No. 5,559,725 discloses an automatic depth control for a trencher.

U.S. Pat. No. 5,212,892 issued May 25, 1993, to Maitlen discloses a cutter head assembly for an excavating machine.

U.S. Pat. No. 4,333,685 issued Jun. 8, 1982, to Arnswald discloses a road surfacing apparatus.

U.S. Pat. No. 4,176,721 issued Dec. 4, 1979, to Poggemiller, et al., discloses a depth control for ground working agricultural implements.

U.S. Pat. No. 2,966,948 issued Jan. 3, 1961, to Ulsh discloses an earth surfacing machine.

U.S. Pat. No. 1,939,389 issued Dec. 12, 1933, to Condron discloses a drag head for dredging machines.

U.S. Pat. No. 5,695,254 issued Dec. 9, 1997, to Kishimoto discloses a road excavator with a rotary cutter.

U.S. Pat. No. 5,713,190 issued Feb. 3, 1998, to Vermeulen, et al., discloses an apparatus for controlling a position adjustable implement.

None of the above disclosed patents teach, disclose, or describe the novel, inventive, useful and unique aspect, elements, and features of the present inventive rotatable implement depth control apparatus.

BRIEF SUMMARY OF THE INVENTION

The rocker of the present invention preferably comprises an obligated steel plate having a normally upwardly oriented face, and a normally downwardly oriented surface contact face. The surface contact face of the rocker preferably has a rearward flat slide surface, a forward flat slide surface, and an arcuately curved slide surface spanning between the rearward and forward flat slide surfaces. In operation of the rocker one of the slide surfaces of the surface contact face is preferably slidably moved along a surface such as a road surface, a wooden surface, or the ground. In order to decrease friction between such slide surface of the rocker and the wooden surface, road surface, or ground, as the case may be, the surface contact face may be configured as rollers rotatably mounted along the length of the rocker. However, for economy in construction and reduction of moving parts, utilization of slide surfaces is preferable. Alternately, the entire surface contact face of the rocker may be configured as an arcuately curved surface. Also alternately, the entire surface contact face of the rocker may suitably be configured as a plurality of differently angled flat slide surfaces positioned in series along the length of the rocker.

Preferably, a support wall is fixedly attached to the normally upwardly oriented face of the rocker, the support wall extending upwardly therefrom. Such support wall preferably has a drive axle aperture therethrough, an hydraulic motor preferably being fixedly mounted upon the support wall and being positioned thereon so that a drive axle may extend therethrough to engage the drive linkage of the hydraulic motor. The hydraulic motor and drive axle are necessarily positioned with respect to the rocker so that, while the surface contact face of the rocker contacts a surface and upon forward or rearward rocking motion of the rocker, the drive axle alternately moves toward and away from the surface. A pneumatic motor or an electric motor may suitably be utilized in place of the hydraulic motor. Alternately, a frame comprising shafts, beams, braces, or columns extending between the hydraulic motor and the rocker may be suitably utilized as a support member.

Any of several rotatable implements or members having an axis of rotation may be fixedly attached to the drive axle driven by the hydraulic motor, electric motor, or pneumatic motor, as the case may be. For example, a wood chipping wheel, blade, or drum may be installed thereon. Also, a rock or pavement grinding wheel, blade, or drum may be installed thereon. Also, a pavement or wood milling wheel, blade, or drum may be installed thereon. Also, a pavement or wood planing wheel, blade, or drum may be installed thereon. Also, a tined earth tiller having an axis of rotation may be installed thereon. As rocking motion, as described above, causes the drive axle to alternately move toward and away from a surface in contact with the surface contact face of the rocker, any of the rotatable implements described above may be caused to selectively engage the surface at varying desired depths.

Where the rotatable member or implement is configured as a wheel or blade, it is preferable that a single rocker be utilized. Where the rotatable member is configured as a drum, having axial length longer than that of a blade or wheel, it is preferable that paired rockers be utilized for enhancement of stability, such paired rockers being installed at either end of the axis of rotation of such rotatable member or implement.

Preferably, the rocker or rockers are removably attached to the wall, shafts, beams, braces, or columns, as the case may be, by means of spirally threaded nuts and bolts passing through attachment flanges having bolt receiving apertures. Suitably, the upper face of the rocker or rockers, as the case may be, may be alternately fixedly welded to such support members.

A rearwardly facing surface of the support wall, or alternate support member, as the case may be, is preferably fixedly welded to a forward face of a mounting plate, so that such wall or member extends forwardly therefrom. Preferably, the rearward face of the mounting plate is adapted for pivotal attachment to the boom arm and bucket ram of a tractor backhoe or excavator, or is adapted for pivotal attachment to the lift arms and bucket rams of a front loader tractor or skid steer loader. Upon such pivotal attachment, the extension shafts of such bucket ram or rams may alternately be extended or retracted, causing the mounting plate to alternately forwardly or rearwardly rotate about a lateral axis; such rotation causing the rocker to alternately rock forwardly or rearwardly. Thus, through alternately extension and retraction such bucket ram or rams, as the case may be, the depth at which the rotatable member or implement engages a surface in contact with the rocker may be selectively adjusted. While it is preferable that the mounting plate be adapted for pivotal attachment to such boom or lift arms and bucket rams, the instant inventive apparatus may suitably be mounted upon any heavy construction implement capable of selectively rotating the mounting plate about its lateral axis and capable of driving the mounting plate forwardly.

Accordingly, it is an object of the present invention to provide selective depth control for a rotatable surface engaging member or implement through the action of a rocker.

Other and further objects, benefits, and advantages of the present invention will become known to those skilled in the art upon review of the Detailed Description which follows and upon review of the appended drawings.

DETAILED DESCRIPTION OF THE PREFERRED EMBODIMENT

Figure 1:
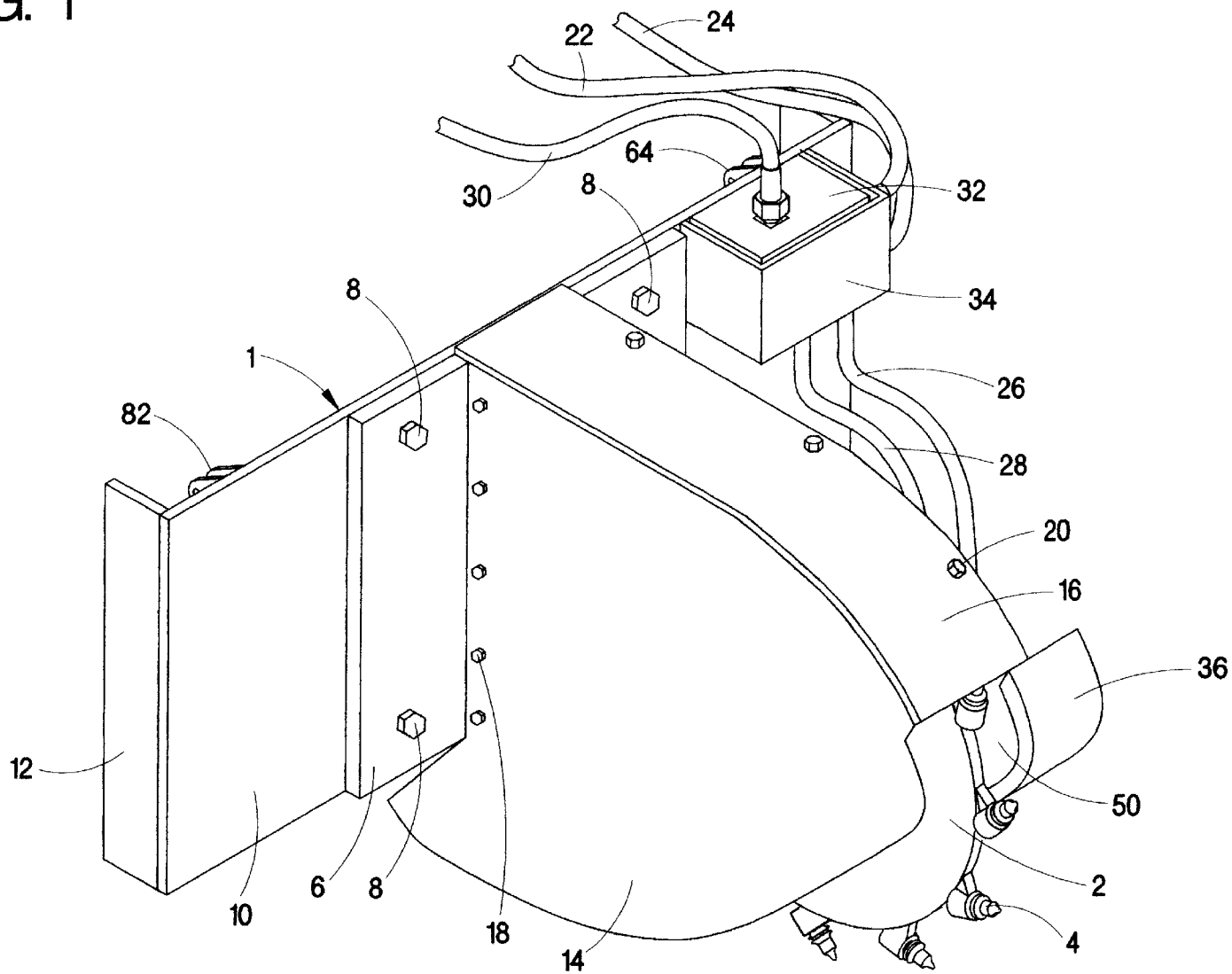
FIG. 1 is an isometric view of the instant inventive rotatable implement depth control apparatus.

Referring to Drawing FIG. 1, the instant inventive rotatable implement depth control apparatus is referred to generally by reference numeral 1.

Figure 2:
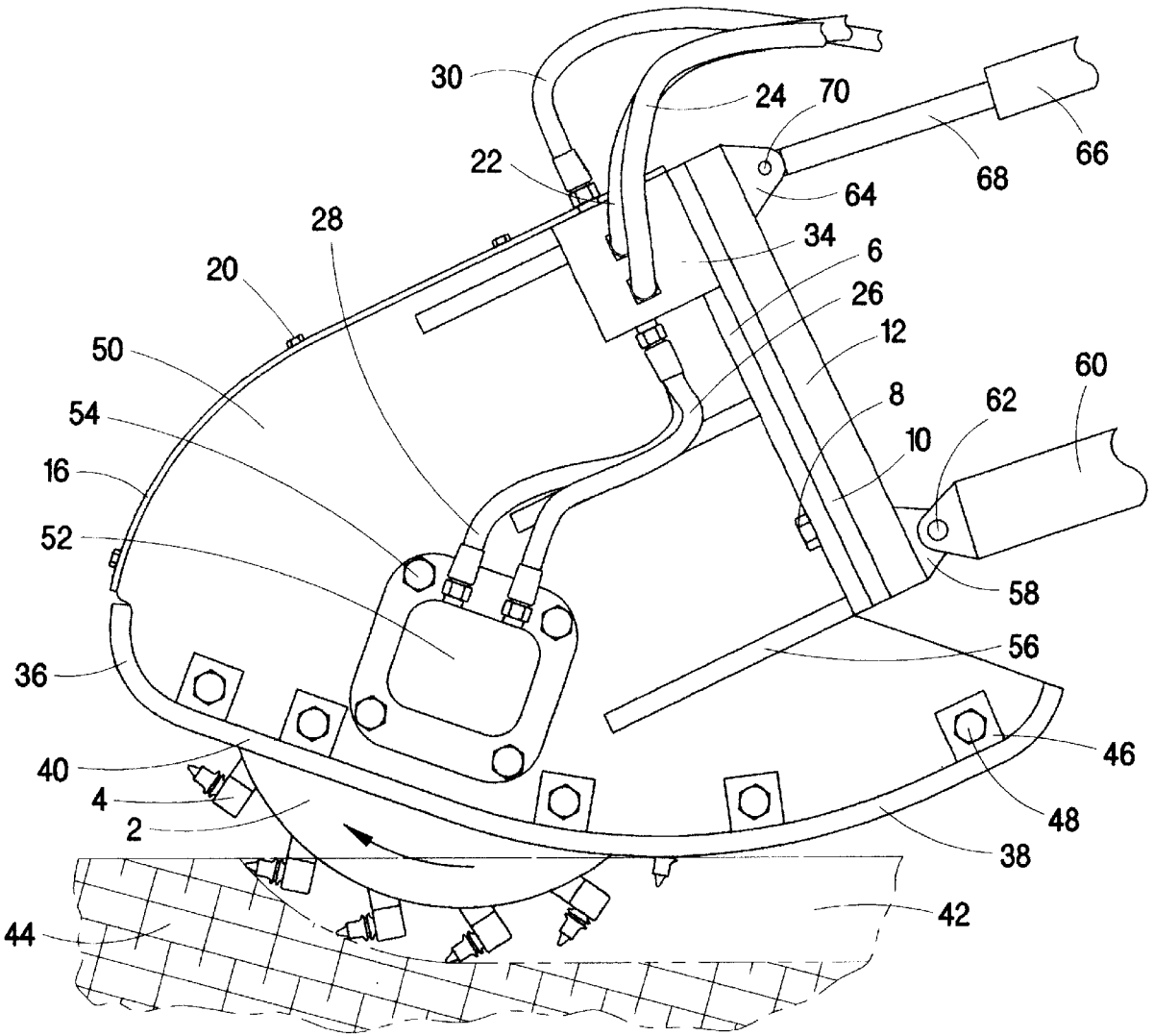
FIG. 2 is a view of the left side of the instant inventive rotatable implement depth control apparatus.

Referring to Drawing FIG. 2, the implement has a rocker 36, the rocker 36 preferably being formed by a metal bending machine from an obligated rectangular steel plate. Preferably, the normally downwardly oriented surface of the rocker 36 serves as a surface contact face. Also, preferably the rocker 36 has a rearward flat sliding surface 38, a forward flat sliding surface 40, and the rocker 36 preferably has an arcuately curved sliding surface situated between the forward and rearward flat sliding surfaces 40 and 38. Alternately, the rocker 36 may be suitably configured as a smooth continuous curve from its forward end to its rearward end. Also alternately, the rocker 36 may be suitably configured as a series of differently angled flat sliding surfaces with no substantial lengths of arcuate curvature there between. Preferably, the surface contact face of the rocker is movable slidably along a surface 44 to be engaged by the apparatus. However, the surface contact face of the rocker may suitably be alternately configured as a series of rollers (not shown) rotatably mounted along the length of the rocker for reduction of sliding friction.

Figure 3:
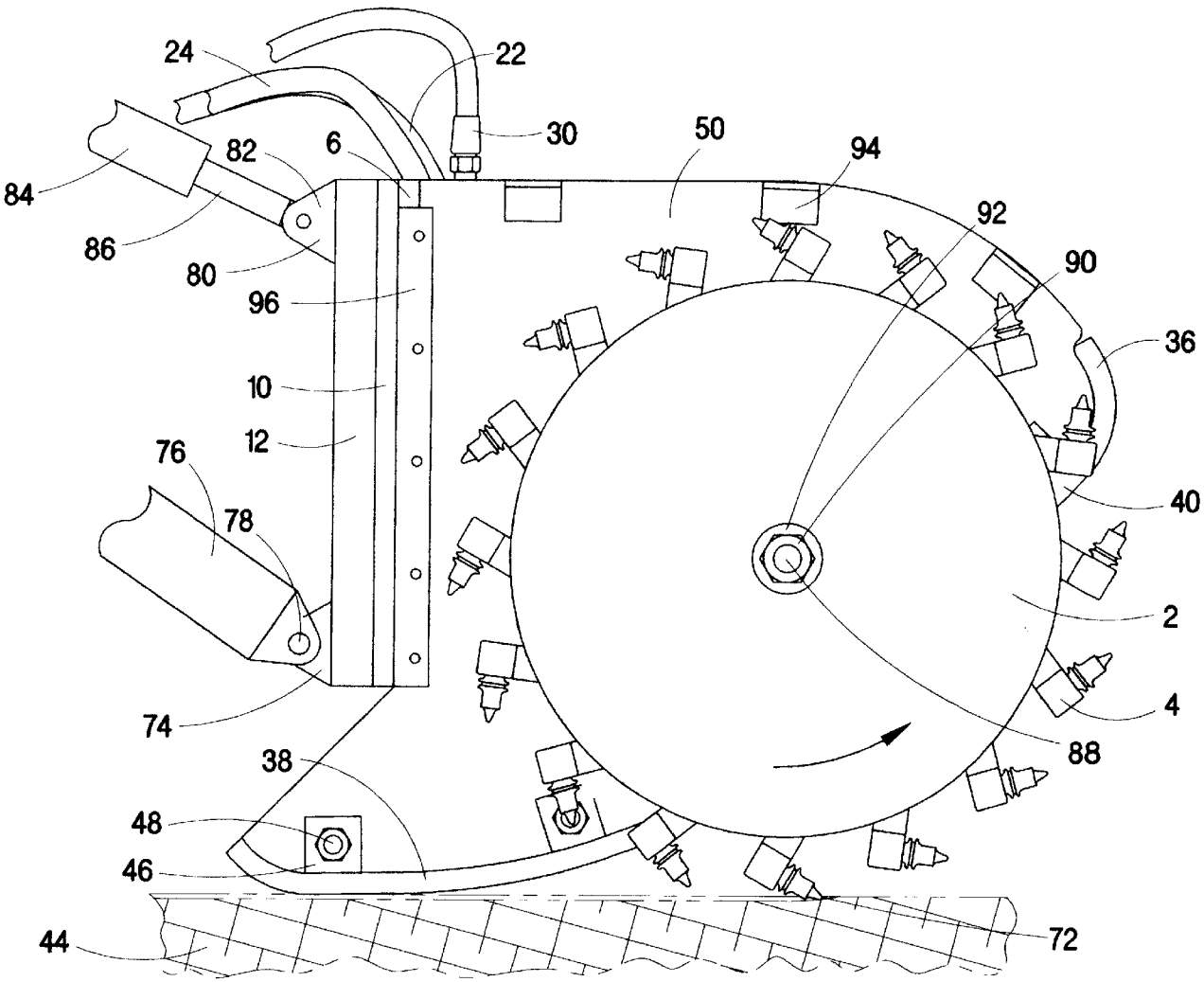
FIG. 3 is a side view of the right side of the instant inventive rotatable implement depth control apparatus, the view showing the apparatus having its protective shroud removed.

Referring simultaneously to FIGS. 2 and 3, the rocker 36 is preferably removably attached to the apparatus by means of spirally threaded bolts 48, such bolts passing through paired ears 46, and through a support wall 50 situated therebetween, the bolts 48 being secured in place by spirally threaded nuts. Alternately, the rocker 36 may suitably be permanently attached to the support wall 50 by means of welds. Removable attachment as described above is preferable because the surface contact face of the rocker 36 is subject to wear as a result of sliding friction, and eventually must be replaced.

Figure 4:
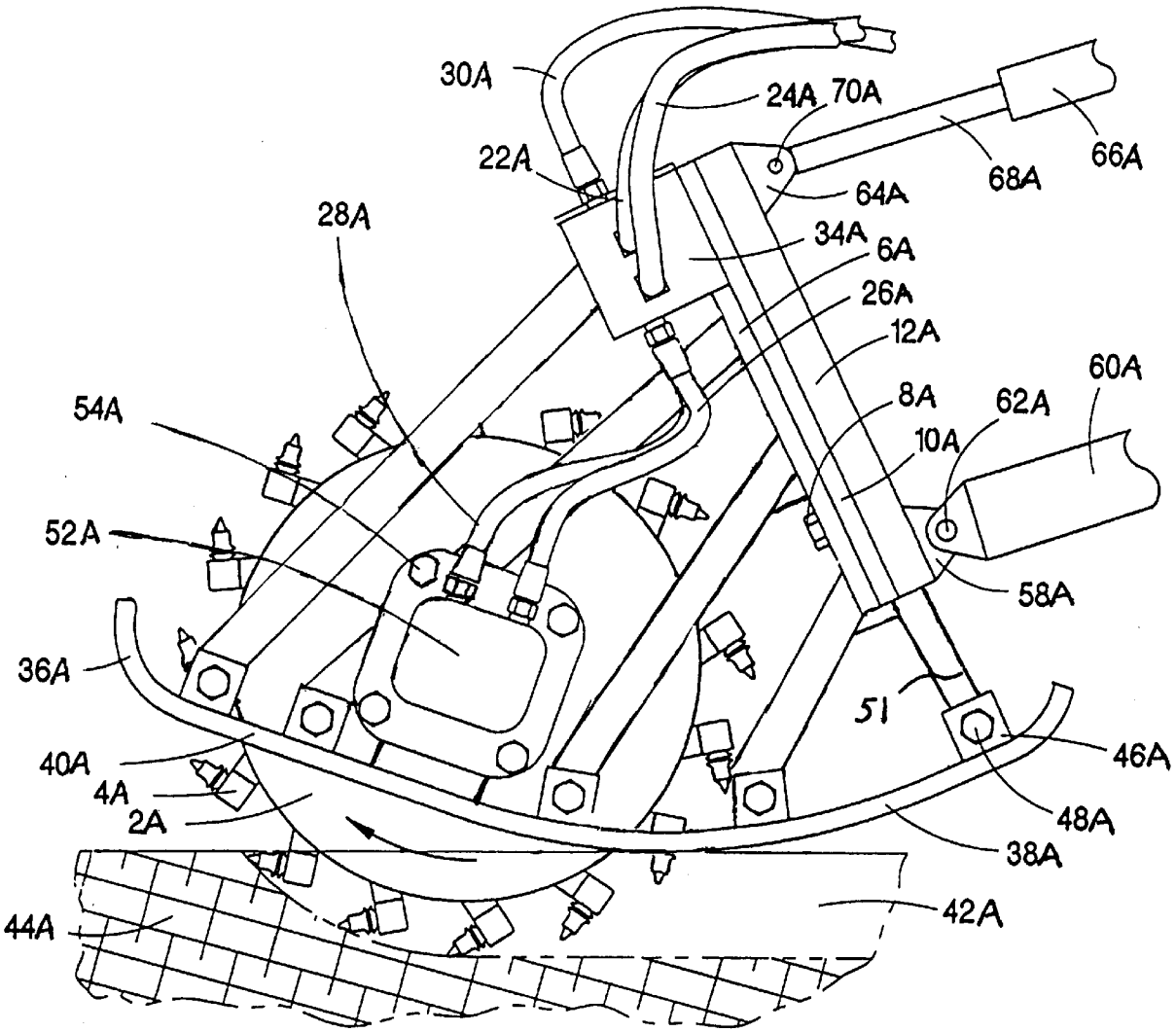
FIG. 4 is a side view of an alternate configuration of the instant inventive rotatable implement depth control apparatus.

Referring simultaneously to FIGS. 2, 3, and 4, structures identified by reference numerals in FIG. 4 having the suffix "A" are identical to similarly numbered structures appearing in FIGS. 2 and 3. Support wall 50 may be suitably alternately constructed as a supporting framework 51 comprising shafts, beams, braces, or columns. However, configuration of the support member as a wall 50 is preferred because the wall 50 serves the dual functions of supporting the rocker 36, the rotatable implement and other structures while providing a shield for protection from flying debris.

Referring to FIG. 2, an hydraulic motor 52 is preferably fixedly mounted upon the left side of the support wall 50 by means of spirally threaded bolts 54. Referring simultaneously to FIGS. 2 and 3, the support wall 50 preferably has an aperture therethrough (not shown) through which a drive axle 88 passes, the drive axle being connected to the drive linkage of the hydraulic motor 52. Referring simultaneously to FIGS. 1 and 2, power to the hydraulic motor 52 is supplied by an hydraulic line 22 which flows into an hydraulic valve box 32. Flow from the hydraulic line 22 to hydraulic lines 26 and 28 extending to the hydraulic motor 52 is controlled by a valve controlling cable 30. Return flow of hydraulic fluid from the hydraulic motor 52 returns to a hydraulic power system (now shown) by an hydraulic return line 24. Preferably, the hydraulic valve box 32 is shrouded and protected by a shield 34. The hydraulic motor 52 may be suitably replaced by an electric motor or a pneumatic motor. Utilization of the hydraulic motor 52 is preferable because heavy construction equipment commonly is equipped with an auxiliary hydraulic power system capable of driving such motors.

Referring to FIG. 2, an exemplary pavement slot cutting wheel 2 having teeth 4 is shown fixedly and axially mounted over the drive axle 88 by means of a spirally threaded nut 90, a washer 92 being disposed between the side wall of the slot cutting wheel 2 and the spirally threaded nut 90. Other rotatable members or implements which may be suitably mounted in place of the exemplary slot cutting wheel 2 are cutting blades and drums; wood chipping wheels, blades and drums; pavement or rock grinding wheels, blades, and drums; wood, rock or pavement milling wheels, blades, and drums; wood, rock or pavement planing wheels, blades, and drums; and tined earth tilling implements. Where the rotatable member or implement is configured as a drum, having a longer axial length than a blade or wheel, it is preferable that paired rockers mounted at either end of the axis of rotation be utilized for additional stability.

Referring simultaneously to FIGS. 1 and 2, the rearwardly facing surface of the support wall 50 is preferably fixedly welded to a first mounting plate 6. Gussets 56 are preferably welded to the left side of the support wall 50 and to the forwardly facing surface of the first mounting plate 6 providing additional support and stiffness. Preferably, the first mounting plate 6 is fixedly and removably attached to a second mounting plate 10 by means of spirally threaded bolts 8. Upon such removable attachment, the first and second mounting plates 10 and 12 function as a single mounting plate. The left and right sides of the second mounting plate 10 are preferably stiffened by reinforcement flanges 12.

Referring simultaneously to FIGS. 2 and 3, the rearwardly facing surface of the second mounting plate 10 preferably is adapted for pivotal attachment to the lift arms and bucket rams of a skid steer loader or tractor front loader by means of paired bucket ram clevis joints 64 and 82, and paired lift arm clevis joints 74 and 58. The lift arms 60 and 76 are pivotally attached to the lift arm clevis joints 58 and 74 by means of shear pins 62 and 78. Similarly, the paired bucket rams 66 and 84 of such front loader tractor or skid steer loader have their extension shafts 68 and 86 pivotally attached to the bucket ram clevis joints 64 and 82 by means of shear pins 70 and 80.

Extension of the extension shafts 68 and 86 causes the second mounting plate 10 to forwardly rotate about its lateral axis, forwardly rocking the rocker 36. Alternate retraction of the extension shafts 68 and 86 rearwardly rotates the second mounting plate 10 about its lateral axis, rearwardly rocking the rocker plate 36. The clevis joints 64, 58, 82, and 74 may be suitably replaced by commonly known and utilized quick attachment and quick release mechanisms. The rearwardly facing surface of the second mounting plate 10 may be alternately suitably configured for pivotal attachment to a single boom arm and bucket ram of a tractor backhoe or excavator.

Referring simultaneously to FIGS. 1 and 3, the right and upper sides of the cutting wheel 2 are protectively shrouded by an upper shroud plate 16 and a side shroud plate 14, the upper shroud plate 16 preferably being fixedly welded to the upper edge of the side shroud plate 14. Removable attachment of the upper shroud plate 16 to the upper edge of the support wall 50 is preferably facilitated by a series of L-brackets 94 which are fixedly welded to the right side of the support wall 50, the L-brackets 94 receiving spirally threaded bolts 20 which pass through the upper shroud plate 16. The rearward edge of the side shroud plate 14 is similarly removably attached by means of an angle iron 96, the angle iron 96 being fixedly welded to the forwardly facing surface of the first mounting plate 6, and by means of spirally threaded bolts 18 passing through the side shroud plate 14 and the angle iron 96.

In operation of the apparatus, referring to FIG. 3, the extension shaft 86 of bucket ram 84 is shown in its retracted position, rotating the second mounting plate 10 rearwardly about its lateral axis and causing the rocker 36 to rearwardly rock so that its rearward flat surface 38 contacts the road 44. In such rearwardly rocked position, the axle 88 of the cutting wheel 2 is raised to an elevation at which, upon rotation of the cutting wheel 2 as indicated by the arrow, its teeth 4 skim the surface of the road 44 cutting a shallow channel 72. Referring to FIG. 2, upon extension of the extension shaft 68 of the bucket ram 66, the second mounting plate 10 is rotated about its lateral axis, forwardly rocking the rocker 36 and lowering the cutting wheel 2 with respect to the road 44, cutting a deeper channel 42. Upon maximum forward rocking of the rocker 36, the forward flat surface 40 of the rocker 36 slides along the road 44, causing the teeth 4 or of the cutting wheel 2 to cut a channel of maximum depth.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An apparatus for engaging a surface, the apparatus comprising:

(a) a rotatable member for engaging the surface, the rotatable member having an axis of rotation;

(b) a rocker, the rocker having a forward end, a rearward end, and a surface contact face, the surface contact face of the rocker extending from the forward end of the rocker to the rearward end of the rocker; and, (c) attaching means rotatably mounting and fixedly positioning the rotatable member over the rocker so that, upon contact of the surface contact face of the rocker with the surface, and upon forward or rearward rocking motion of the rocker, the axis of rotation of the rotatable member moves away from or toward the surface, causing the rotatable member to engage the surface at varying depths.

2. The apparatus of claim 1, wherein the rotatable member is selected from the group of chipping wheels, chipping blades, chipping drums, cutting wheels, cutting blades, cutting drums, grinding wheels, grinding blades, grinding drums, milling wheels, milling blades, milling drums, planing wheels, planing blades, planing drums, or tined earth tillers.

3. The apparatus of claim 2, further comprising motor means for rotating the rotatable member about its axis of rotation.

4. The apparatus of claim 3, wherein the rocker has a face opposite the surface contact face, wherein the attaching means comprises a drive axle fixedly attached to the rotatable member, and wherein the attaching means further comprises a support member selected from the group of walls, shafts, beams, braces, or columns.

5. The apparatus of claim 4, wherein the motor means is selected from the group of hydraulic motors, electric motors, or pneumatic motors, the motor means being operatively connected with the drive axle for transmission of rotational torque to the drive axle.

6. The apparatus of claim 5, wherein the surface contact face of the rocker comprises an arcuately curved surface.

7. The apparatus of claim 6, wherein the surface contact face of the rocker further comprises a first substantially flat surface positioned forward or rearward of the arcuately curved surface.

8. The apparatus of claim 7, wherein the surface contact face of the rocker further comprises a second substantially flat surface positioned at the end of the arcuately curved surface opposite the first substantially flat surface.

9. The apparatus of claim 5, wherein the surface contact face of the rocker comprises a plurality of differently angled flat surfaces.

10. The apparatus of claim 6, further comprising a mounting plate having a forward face and a rearward face, the support member being fixedly attached to and extending forwardly from the forward face of the mounting plate, the rearward face of the mounting plate being adapted for pivotal attachment to a boom arm or lift arm.

11. The apparatus of claim 7, further comprising a mounting plate having a forward face and a rearward face, the support member being fixedly attached to and extending forwardly from the forward face of the mounting plate, the rearward face of the mounting plate being adapted for pivotal attachment to a boom arm or lift arm.

12. The apparatus of claim 8, further comprising a mounting plate having a forward face and a rearward face, the support member being fixedly attached to and extending forwardly from the forward face of the mounting plate, the rearward face of the mounting plate being adapted for pivotal attachment to a boom arm or lift arm.

13. The apparatus of claim 9, further comprising a mounting plate having a forward face and a rearward face, the support member being fixedly attached to and extending forwardly from the forward face of the mounting plate, the rearward face of the mounting plate being adapted for pivotal attachment to a boom arm or lift arm.

14. The apparatus of claim 6, wherein the rocker is removeably attached to the support member.

15. The apparatus of claim 7, wherein the rocker is removeably attached to the support member.

16. The apparatus of claim 8, wherein the rocker is removeably attached to the support member.

17. The apparatus of claim 9, wherein the rocker is removeably attached to the support member.

* * * * *